US010946265B2

(12) United States Patent
Zoor

(10) Patent No.: US 10,946,265 B2
(45) Date of Patent: Mar. 16, 2021

(54) HOLDING ELEMENT FOR A SKI BOOT WITH A TILTABLE FITTING PEDAL

(71) Applicant: SKIS ROSSIGNOL, Saint-Jean-de-Moirans (FR)

(72) Inventor: Reinhold Zoor, Eichenau (DE)

(73) Assignee: SKIS ROSSIGNOL, Saint-Jean-de-Moirans (FR)

( * ) Notice: Subject to any disclaimer, the term of this patent is extended or adjusted under 35 U.S.C. 154(b) by 82 days.

(21) Appl. No.: 16/077,524

(22) PCT Filed: Feb. 16, 2017

(86) PCT No.: PCT/EP2017/053484
§ 371 (c)(1),
(2) Date: Aug. 13, 2018

(87) PCT Pub. No.: WO2017/140767
PCT Pub. Date: Aug. 24, 2017

(65) Prior Publication Data

US 2019/0070483 A1 Mar. 7, 2019

(30) Foreign Application Priority Data

Feb. 17, 2016 (DE) ..... 10 2016 001 887.9
Jun. 4, 2016 (DE) ..... 10 2016 006 850.7

(51) Int. Cl.
*A63C 9/00* (2012.01)
*A63C 9/08* (2012.01)
(Continued)

(52) U.S. Cl.
CPC ..... *A63C 9/006* (2013.01); *A63C 9/086* (2013.01); *A63C 9/0807* (2013.01);
(Continued)

(58) Field of Classification Search
CPC ..... A63C 9/00; A63C 9/006; A63C 9/0807; A63C 9/0842; A63C 9/0846;
(Continued)

(56) References Cited

U.S. PATENT DOCUMENTS 3,481,615 A * 12/1969 Salomon ..... A63C 9/08 280/626
3,643,977 A * 2/1972 Berlenbach ..... A63C 9/005 280/632
(Continued)

FOREIGN PATENT DOCUMENTS

DE 10 2010 006 218 A1 8/2011
DE 10 2014 001 255 A1 8/2014
(Continued)

OTHER PUBLICATIONS

Germany Search Report dated Jan. 13, 2017 issued in corresponding application No. DE102016006850.7; w/English machine translation (14 pages).
(Continued)

*Primary Examiner* — James M Dolak
(74) *Attorney, Agent, or Firm* — Westerman, Hattori, Daniels & Adrian, LLP

(57) ABSTRACT

Rear holding element for a ski boot comprising a heel grip (11), a lever (6) and a fitting pedal (7), characterized in that the fitting pedal (7) is mobile relative to the heel grip (11).

19 Claims, 8 Drawing Sheets

(51) Int. Cl.
*A63C 9/084* (2012.01)
*A63C 9/086* (2012.01)

(52) U.S. Cl.
CPC ..... *A63C 9/0842* (2013.01); *A63C 9/0846* (2013.01); *A63C 9/0847* (2013.01)

(58) Field of Classification Search
CPC ..... A63C 9/0847; A63C 9/086; A63C 9/084; A63C 9/0841; A63C 9/0844; A63C 7/00; A63C 7/1073; A63C 7/108; A63C 7/10
See application file for complete search history.

(56) References Cited

U.S. PATENT DOCUMENTS 3,776,567 A * 12/1973 Shimizu ..... A63C 9/0844 280/631
4,061,356 A * 12/1977 Salomon ..... A63C 7/1013 280/605
4,061,357 A * 12/1977 Salomon ..... A63C 7/1013 280/605
4,135,728 A * 1/1979 Salomon ..... A63C 7/102 280/605
4,168,083 A * 9/1979 Storandt ..... A63C 9/0844 280/605
4,496,167 A * 1/1985 Krob ..... A63C 7/1013 280/605
4,615,536 A * 10/1986 Stritzl ..... A63C 9/0844 280/631
5,092,621 A * 3/1992 Horn ..... A63C 9/0846 280/618
5,096,218 A * 3/1992 Bardin ..... A63C 9/005 280/633
5,145,203 A * 9/1992 Gorza ..... A63C 9/0846 280/632
5,228,715 A * 7/1993 Sedlmair ..... A63C 9/0842 280/620
5,265,901 A * 11/1993 Gorza ..... A63C 7/1013 280/605
6,073,955 A * 6/2000 Chonier ..... A63C 7/1093 280/604
6,244,617 B1 * 6/2001 Chonier ..... A63C 7/1013 280/605
6,450,526 B1 * 9/2002 Bressand ..... A63C 9/0842 280/626
6,454,291 B1 * 9/2002 Hillairet ..... A63C 9/0842 280/616
7,267,356 B2 * 9/2007 Buquet ..... A63C 9/0844 280/616
8,181,985 B2 * 5/2012 Mangold ..... A63C 7/1013 280/613
8,398,110 B2 * 3/2013 Morin ..... A63C 9/00 280/614
8,746,728 B2 * 6/2014 Shute ..... A63C 9/0845 280/614
8,827,302 B2 * 9/2014 Fritschi ..... A63C 9/006 280/623
9,457,259 B2 * 10/2016 Brandl ..... A63C 9/001
9,901,806 B2 * 2/2018 Fritschi ..... A63C 7/102
2011/0203138 A1 8/2011 Shute et al.

FOREIGN PATENT DOCUMENTS

DE 10 2014 004 874 A1 10/2015
EP 0 199 098 A2 10/1986
EP 2 351 603 A2 8/2011
FR 2 117 017 A5 7/1972
WO 2009/105866 A1 9/2009

OTHER PUBLICATIONS

International Search Report and Written Opinion dated May 12, 2017 issued in corresponding application No. PCT/EP2017/053484; w/ English partial translation and partial machine translation (22 pages).
Office Action dated May 20, 2020, issued in counterpart EP Application No. 17 711 571.4, with English translation (6 pages).

* cited by examiner 6
11
7
8
35
12
5
3'
19
9
17
3
16
4

3
3
12
18
6
7
8
5

HOLDING ELEMENT FOR A SKI BOOT WITH A TILTABLE FITTING PEDAL

The present invention relates to a ski fixing with a front holding element for a boot and a rear holding element for a boot, in which a ski boot can tilt into a climbing position about the front holding element for the boot and be tightly fastened in a descent position between a front holding element for a boot and a rear holding element for a boot through a locking mechanism and the locking mechanism is produced in such a way that the locking begins only when the ski boot is positioned in the descent position.

There are solutions for fixing a boot on a ski for practising touring skiing, but which exhibit all or some of the following drawbacks:

- they can offer a lack of safety in the lowered configuration, inducing a risk, in case of a fall of the skier, of his or her boot remaining captive of the fixing on the ski, which can cause injuries to the skier;
- the actuation from the climbing configuration to the descent configuration, and vice versa, relies on a complex and/or not very user-friendly device;
- in climbing configuration, the rear holding element can represent a hindrance.

The aim of the present invention is to propose a solution for fixing a boot on a gliding board which remedies the drawbacks listed above of the prior art solutions.

More specifically, one object of the present invention is to provide a solution for fixing a boot that is secure, simple, economical and user-friendly.

The invention relates to a method for using a ski fixing and to a ski fixing as such. It relates also to a rear boot holding element of such a ski fixing. It relates finally also to a touring ski equipped with such a ski fixing.

The invention relates to a method of using a ski fixing, characterized in that, to position the heel grip using the ski boot heel in the descent position of the ski boot, a mobile fitting pedal is tilted at the heel grip by a lever into the tilting zone of the ski boot, and, for the climbing position of the heel grip, the fitting pedal tilts outwards out of the tilting zone of the ski boot.

The lever can form a climbing aid, taking the form of a ski boot cleat, and form an opening lever for the locking of the heel. For that, the lever can form the climbing aid by tilting forwards and can open the heel grip by tilting backwards.

The invention relates also to a rear holding element for a ski boot comprising a heel grip, a lever and a fitting pedal, characterized in that the fitting pedal is mobile relative to the heel grip.

The fitting pedal can be articulated on the heel grip.

The fitting pedal can occupy the following positions:

- a tilted position of rest at the heel grip in which it is outside of the trajectory of a ski boot in climbing position of the rear holding element;
- a fitting position in which it is on the trajectory of a ski boot.

The invention is more specifically defined by the claims.

Other advantages and features will emerge more clearly from the following description of particular embodiments of the invention given as nonlimiting examples and represented in the attached drawings, in which:

FIG. 13 illustrates a cross-sectional side view of the braking device of the rear boot holding element according to the embodiment of the invention in a fitting position.

Figure 1:
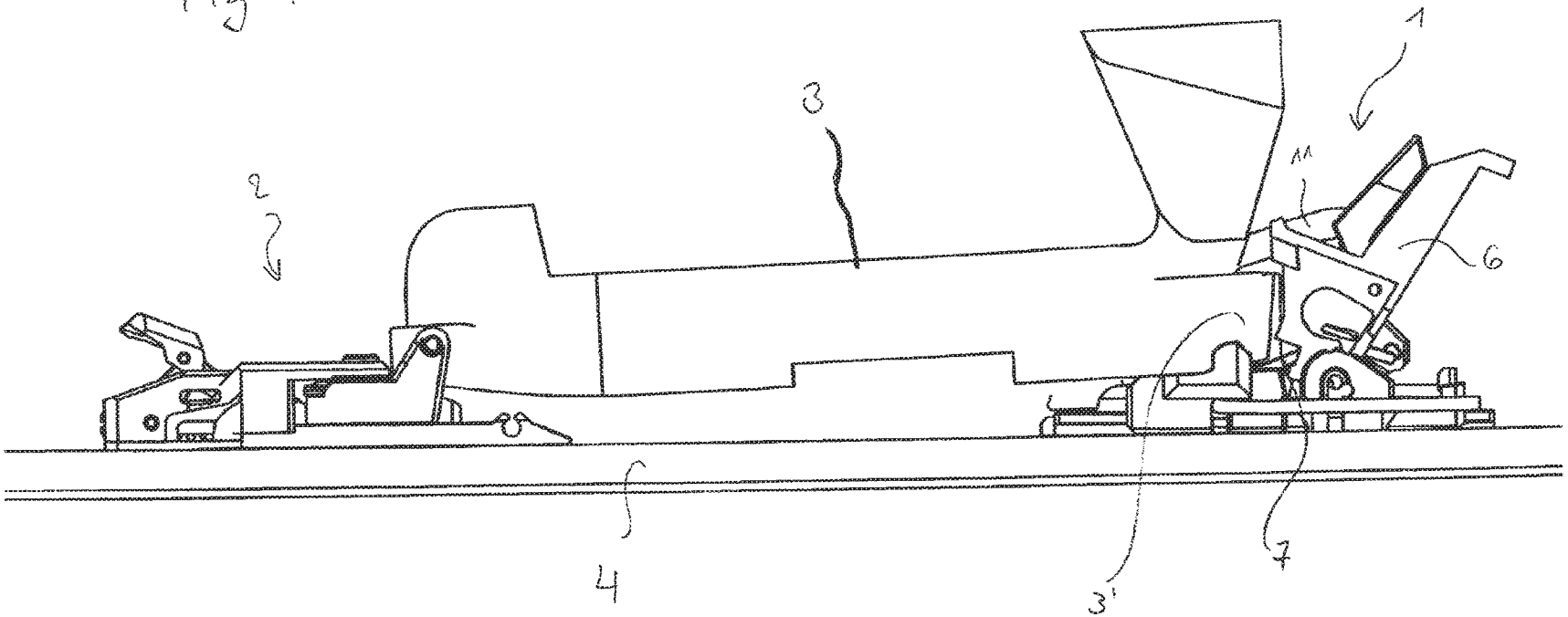
FIG. 1 illustrates a ski fixing according to one embodiment of the invention with a front boot holding element and a rear boot holding element, in which a ski boot is tightly fastened in a descent position between the front boot holding element and the rear boot holding element through a locking mechanism.

In the different figures, the reference numbers used represent:

1. Rear ski boot holding element.
2. Front ski boot holding element.
3. Ski boot. 3'—ski boot heel.
4. Ski.
5. Point of rotation—the lever is arranged in such a way that it can tilt on a curved line about the point of rotation 5. This point of rotation is arranged on a transverse axis.
6. Lever—multifunction. Climbing aid tilted forwards to support the heel of the ski boot, opening lever pushed backwards for the opening of the heel grip 11 when the latter is (closed) in the descent position. Can also offer housing for the contact means 9 and for the anti-overload protection 10, as well as housings for the additional climbing aid 12.
7. Fitting pedal—assumes a first position of availability, or lowered, in the position ready for fitting, or of fitting of the rear boot holding element, to fit the ski boot in the descent position. Assumes a second position of rest in the climbing position of the heel grip 11 and of the rear boot holding element.
8. Abutment for the fitting pedal—the fitting pedal is controlled by the contact means 9 at the lever 6 in such a way that it tilts from its position of rest (in other words in an upward retracted position) to a position of availability, or ready for fitting, to be able to close the heel grip 11 using the heel 3' of the ski boot 3.
9. Contact means at the lever 6—driving function for controlling the fitting pedal 7.

10. Anti-overload protection in case of incorrect use—if the opening lever 6 has to be pivoted backwards and the fitting pedal 7 be hampered, by an object such as, for example, the boot, during the tilting, the anti-overload protection prevents damage to the functional parts, for example to the contact means 9 and the abutment 8. The anti-overload protection can for example be produced in the form of a spring with two branches in which one branch bears against the lever 6 and the second lever forms the contact means 9 interacting for example with the abutment parts 8 of the fitting pedal 7 in such a way that the fitting pedal tilts from its position of rest 7 to its position of availability (FIG. 2), when the opening lever 6 is pivoted backwards.

11. Heel grip—the heel grip 11 holds, in its closed position, the ski boot in the descent position of the rear boot holding element. The heel grip comprises, among other things, the spur support 33 and the spur housing 34. The heel grip is linked to the baseplate 31 via spring-loaded means controlling the safety trip. In climbing position of the rear boot holding element, the heel grip 11 is open.

12. Additional climbing aid—one or more additional cleats, that can for example tilt in climbing mode, for supporting the heel of the ski boot, when the lever 6 is tilted forwards (corresponding to the climbing aid lever 6 position).

13. Guiding abutments are necessary at the brake baseplate level when the lateral bearing forces exerted when skiing cannot be absorbed only by the geometrical form of the heel grip 11. The abutments prevent the boot heel from being able to deflect laterally.

14. Stop tooth—to position the lever 6 in different working positions, the stop tooth of the stop ratchet 17 meshes with an indentation 35 on the stop flange 32.

15. Control for the lock of the ski brake. Necessary to keep the ski brake also without the ski boot in the climbing mode (out of service) by obstructing the brake stirrups 24 against the action of the spring of the brake. In other words, in climbing position, the brake lock control blocks the brake branches 24 in raised position for the braking position never to be active. If the ski fixing is placed in the descent position, the lock of the ski brake opens and the latter must assume a position of availability and can be tripped at any moment in the case of a fall. In other words, in fitting position or descent position of the rear boot holding element, the brake lock control no longer acts on the brake branches 24 and the branches are free to be able to be pivoted upwards or downwards to pivot from the non-braking raised position to the braking lowered position.

In particular, the brake lock control 15 is actuated by the heel grip 11 when it tilts to closed position or descent position during fitting, that is to say that the heel grip 11 pushes the brake control 15 towards the front of the fixing element. This brake lock control 15 then makes it possible to displace the stop device of the brake 28 to release the brake, for it to be able to freely switch from the closed to open positions and vice versa.

The stop device of the brake 28 is a latch in the form of a hook which cooperates with the brake pedal 16 and makes it possible to block the rotational movements of the brake for the climbing position, when the heel grip 11 no longer acts on the lock control 15. The brake stop device 28 is stressed by a return spring which positions it automatically in backward pushed-back position to allow the locking of the brake.

16. Ski brake pedal, which can comprise abutments in which the brake control 15 of a locking part meshes to keep the ski brake in closed position (function blocked) when the rear holding element is in the climbing mode. When the rear holding element is switched to the descent position, the ski brake locking parts 28 release the ski brake into the brake availability state.

17. Stop ratchet with stop tooth which can preferably also comprise the bearing and/or housing for the anti-overload protection 10.

18. Ski pole—18' ski pole basket that can trigger the climbing aid lever 6 when it is pulled forwards in the direction of the advance, with the trip hook 25.

19. Climbing aid support—one or more cleats provided on the lever 6 for the ski boot heel in the climbing mode when the lever 6 is tilted forwards (climbing aid lever).

20. Ski brake baseplate—bottom support for the ski boot in descent position, also comprises the control elements for the ski brake 24 and the guiding abutments 13.

21. Fixing rail—is fixed onto the ski and supports, for example via a T groove link, the baseplate 31 which can be slid in the longitudinal direction of the ski.

22. Length adjustment thread in the fixing rail.

23. Length adjustment screw, acts together with the length adjustment thread 22 to adjust the baseplate 31 that can be slid in the longitudinal direction of the ski elastically relative to the fixing rail over a necessary ski boot length. Preferably, the length adjustment screw bears directly against a compression spring bearing in turn against the housing.

24. Ski brake stirrup—must prevent the ski from running uncontrollably down the slope in case of a fall.

25. Trip hook making it possible to displace the lever 6 forwards with a suitable ski pole basket 18'.

26. Eyelet for the pole at the lever level, to displace the lever 6 backwards using the ski pole 18.

27. Eyelet for the pole on the additional climbing aid to control the climbing aid lever 12 using the ski pole 18.

28. Ski brake lock or ski brake stop device—keeps, via the pedal 16, the ski brake 24 positioned in such a way that the brake stirrups or branches cannot catch the snow during climbing.

29. Ski brake control curves controlling a metal wire stirrup with ski brake spring automatically into its braking position.

30. Climbing aid stop—positions the stirrup 6 in predetermined angular positions.

31. Baseplate—slides via a T groove guide on the fixing rail 21, supports the control mechanism for the heel grip 11, the ski brake baseplate and the stop flange 32.

32. Stop flange—can comprise the indentation 35 and the point of rotation 5 for the lever 6.

33. Fitting pedal support—which will push the fitting pedal downwards by means of the heel of the ski boot, the heel of the boot can press against the support of the fitting pedal when the heel grip is in the open position such that the heel grip can pivot into its closed position.

34. Indentation—interacts with the stop ratchet 17.

35. Fitting pedal housing designed to directly or indirectly house the tiltable fitting pedal 7 and/or designed in such a way that the fitting pedal, when it is produced as an automatic return spring, forms the counter-bearing of the spring.

The invention will now be explained in more detail.

Figure 2:
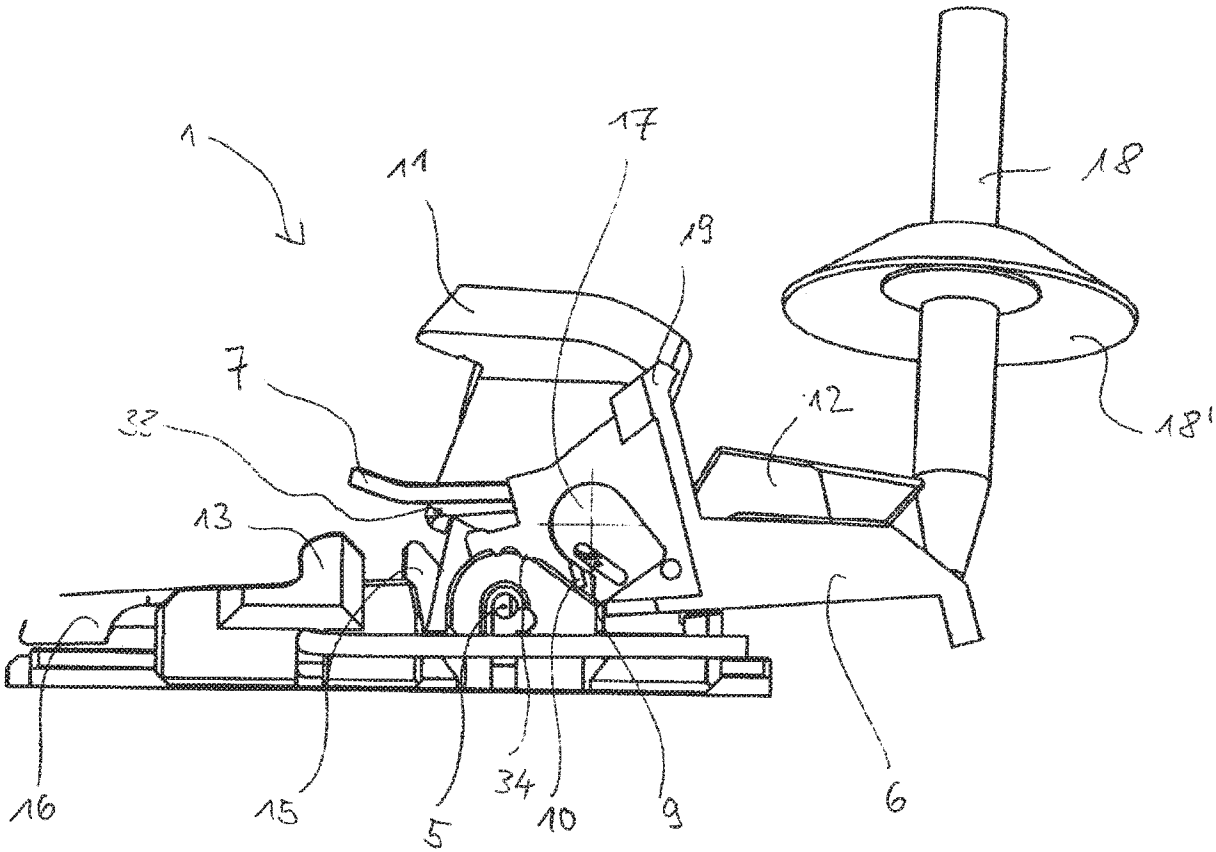
FIG. 2 illustrates a rear boot holding element according to the embodiment of the invention in fitting position and in phase of manipulation with a ski pole.

FIG. 2 therefore represents the fitting pedal 7 in a position of availability making it possible to close the heel holding element by means of a ski boot heel. The rear boot holding element is therefore in fitting position in FIG. 2. In other words, the fitting pedal 7 is in lowered position for the heel of the boot to be able to press on top at the time of fitting and tilt the heel grip 11 forwards to bring it into fitted position in which the heel of the boot is held by this heel grip, to thus bring the rear boot holding element into closed position, represented by FIG. 1.

Figure 3:
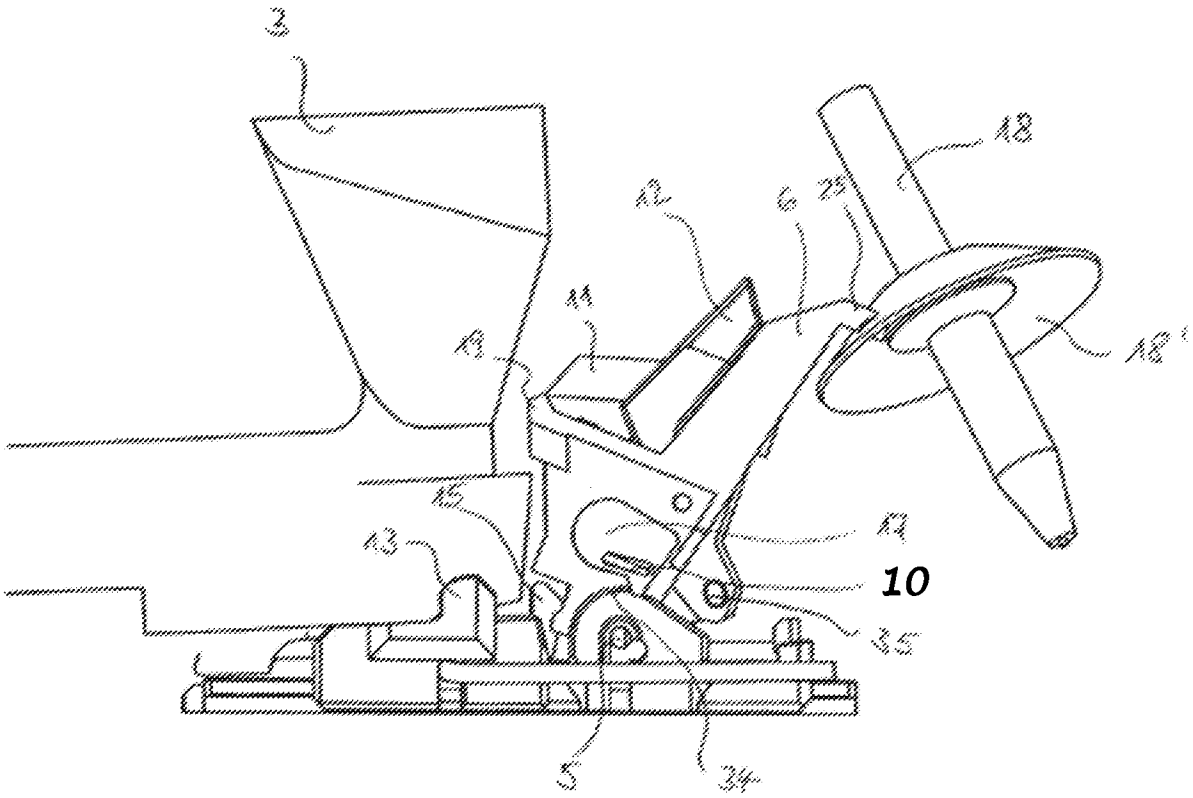
FIG. 3 illustrates a rear boot holding element according to the embodiment of the invention in a climbing position and a ski boot in a lowered position.

FIG. 3 illustrates a rear holding element in a climbing position and a ski boot in a climbing position that is the lowest possible, the boot being held between two inserts of the front boot holding element and being able to tilt on a curved line about the front boot holding element. FIG. 3 also illustrates a ski pole tripping a lever 6 to drive the heel grip II rotationally upwards into open position and retract the fitting pedal 7 upwards to reach the climbing position.

Figure 4:
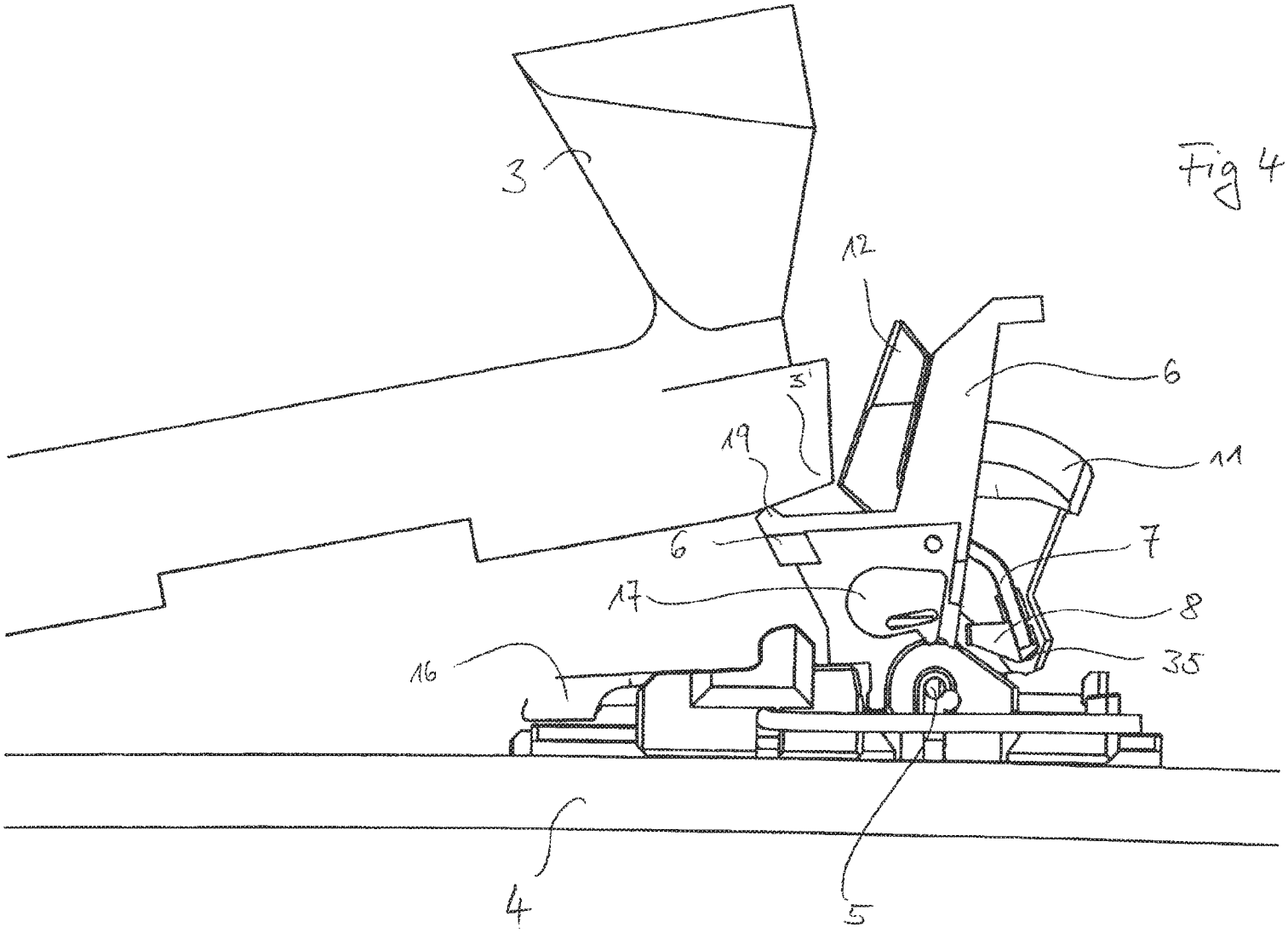
FIG. 4 illustrates a rear boot holding element according to the embodiment of the invention in a climbing position and a ski boot in an intermediate climbing position pressing on a climbing aid lever.
Figure 5:
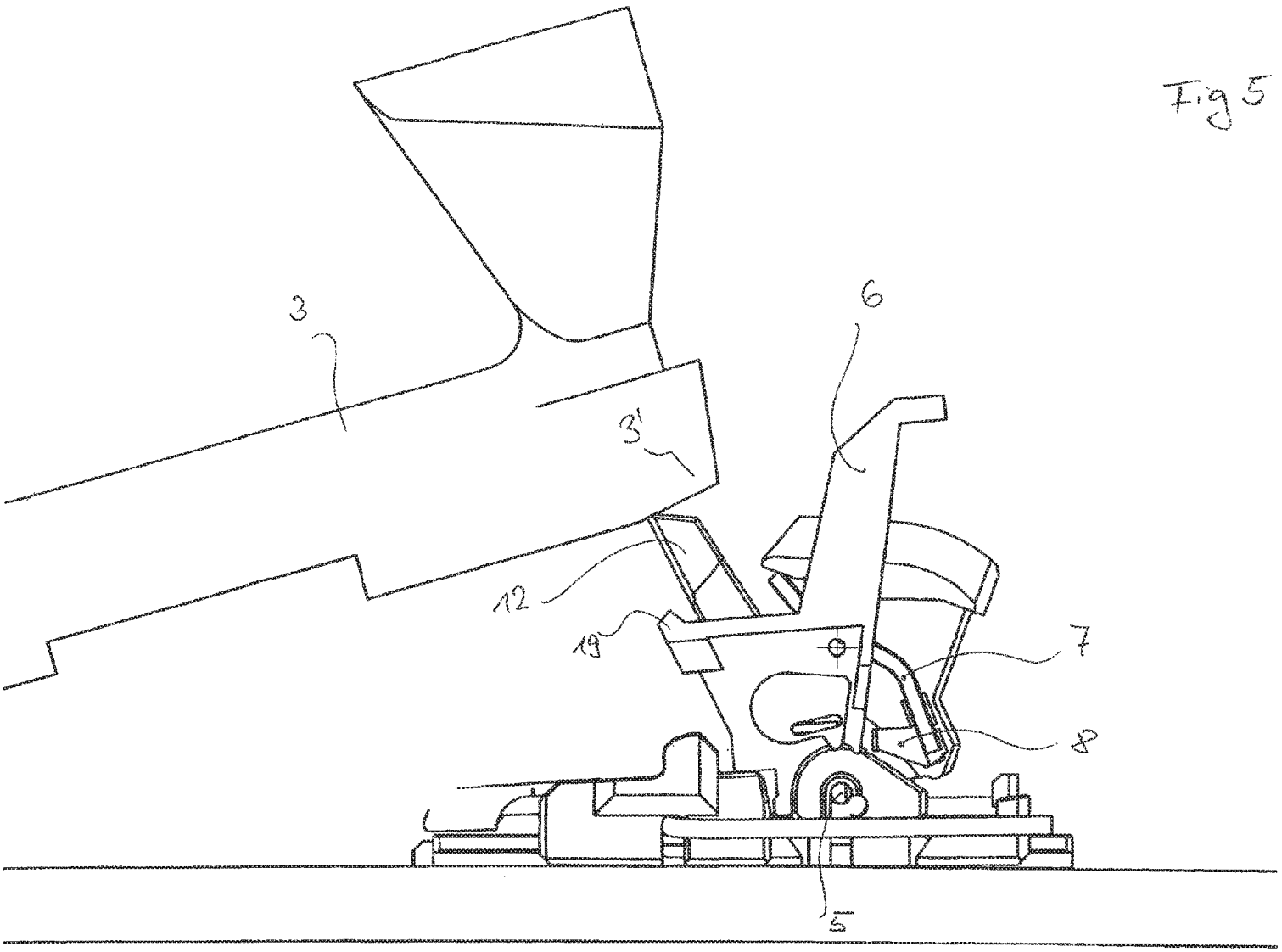
FIG. 5 illustrates a rear boot holding element according to the embodiment of the invention in a climbing position and a ski boot in a top climbing position pressing on an additional climbing aid lever.
Figure 7:
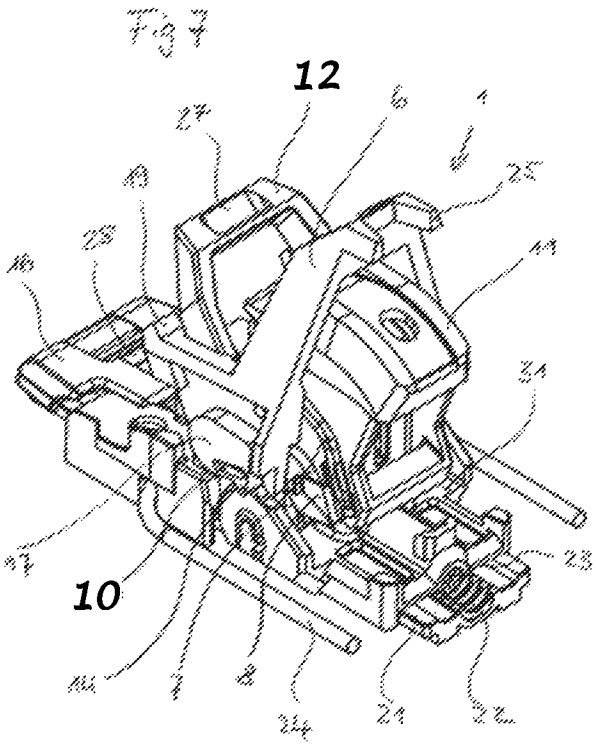
FIG. 7 illustrates a rear boot holding element according to the embodiment of the invention in isometric view from the rear.
Figure 6:
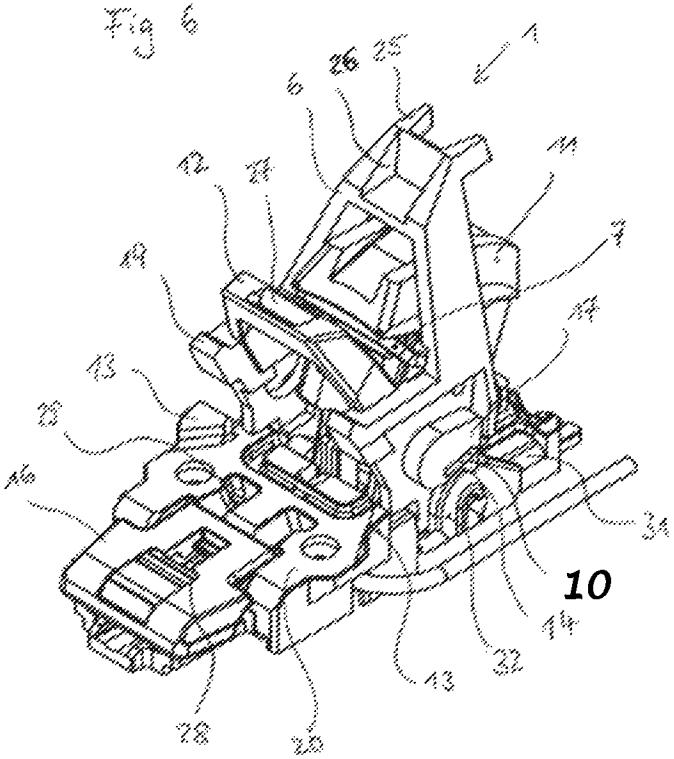
FIG. 6 illustrates a rear boot holding element according to the embodiment of the invention in isometric view from the front.

FIGS. 4 and 5 illustrate other positions of the ski boot in a climbing position of the rear boot holding element. FIG. 5 illustrates more specifically the rear boot holding element in a climbing position and a ski boot in a top climbing position pressing on an additional climbing aid lever. In this position, the fitting pedal 7 is in its position of rest, in other words in its raised position against the top part of the heel grip 11.

The invention therefore consists in fixing a ski boot between a front holding element for a boot and a rear holding element for a boot in a ski fixing such that it is held in a climbing position between two inserts of the front holding element for a boot and can tilt on a curved line about the front holding element then be fixed relative to the ski in a descent position, to fix the ski boot to the rear holding element, in which the heel grip 11 of the rear holding element does not include the rigid fitting tongue that is usually found on comparable ski fixings for the closing of the rear holding element but comprises a mobile fitting pedal or fitting tongue 7 on the heel grip 11 which will be tilted into the tilting zone (that is to say on the trajectory) of the ski boot 3 before the positioning of the ski boot 3 in the descent position of the rear holding element—hereinafter called "fitting position"—and the fitting pedal 7 will be tilted out of the tilting zone (out of the trajectory) of the ski boot 3 for the climbing position of the rear holding element.

In other words, the rear holding element has a heel grip 11 intended to hold the heel of the boot in descent position, this heel grip 11 comprises a fitting tongue 7 which is not of a single piece with the heel grip 11 but which is articulated on the heel grip 11.

In fitting position of the rear boot holding element, the fitting tongue or fitting pedal 7 is positioned downwards in such a way that the heel of the boot can come to bear on top during fitting to drive the heel grip 11 rotationally to its position of closure or of holding of the heel of the boot, and do so for the descent. In descent position, the fitting pedal 7 is therefore positioned under the boot.

In climbing position, the fitting pedal 7 is tilted upwards against the top part of the heel grip II to allow the upward rotation of the boot, the heel of the boot then no longer being held by the heel grip 11. The heel of the boot will be able to come to rest directly on the base of the rear holding element without being hampered by the fitting tongue 7 as would be the case in a traditional rear fixing element.

It is possible in this particular case to distinguish two states of the rear holding element:

1. The ski fixing is in the descent position and the heel grip 11 will have to be tilted upwards to reach the climbing position.

The heel grip 11 is in the "closed" position. The heel 3' of the ski boot 3 is fixedly linked to the ski. The fitting pedal 7 is under the heel of the ski boot 3 (FIG. 1). To release the ski boot heel for climbing, the heel grip 11 is controlled by backward pressure of the lever 6. The heel grip 11 tilts into its open position, the heel of the ski boot 3 is released and the fitting pedal 7 automatically performs a spring movement on the basis of intrinsic spring properties or additional spring means, into its raised standard position of rest 7. The boot heel can then tilt freely, without striking the fitting pedal, which is retracted in this position of rest. The lever can also serve as climbing aid 6 when it is placed forwards.

Also, in this standard position of rest, the fitting pedal 7 occupies its position in which it is positioned in the top part of the heel grip 11. This fitting pedal 7 is in particular formed by a U-shaped metal wire, but this pedal could be wider, particularly in the boot bearing zone.

2. The ski fixing is in the climbing position and the heel grip 11 will have to be closed to switch to descent position.

To close the heel grip 11 using the heel of the boot 3, the fitting pedal 7 must be tilted inwards out of its position of rest into the tilting zone of the heel of the boot 3. To this end, the lever 6 is preferably compressed backwards (6). In this particular case, the driving element contact means 9 on the lever 6 control the fitting pedal 7 via the abutments 8 provided on the fitting pedal 7, to switch it from its standard position of rest into a fitting position in FIG. 2. Thus, when the heel 3' of the ski boot 3 compresses the fitting pedal downwards, the heel grip 11 will be closed and the ski boot is in the descent position.

The present invention can also have the following features, in particular:

a mobile fitting pedal 7 is tilted into the tilting zone of the ski boot 3, at the heel grip 11, via the lever 6, to position the heel grip 11 using the heel 3' of the ski boot in the descent position (FIG. 1) of the ski boot 3, and the fitting pedal 7 tilts outwards out of the tilting zone of the ski boot 3 for the climbing position of the heel grip 11, that is to say that the fitting pedal then tilts upwards;

the lever 6 just as well forms the climbing aid 6 by taking the form of a ski boot cleat as the opening lever 6 for the heel lock;

by forward tilting, the lever 6 forms the climbing aid 6 and, by tilting, opens the heel grip 11 backwards;

the lever 6 comprises contact means 9 which tilt the fitting pedal 7 inwards (that is to say downwards) and/or outwards (that is to say upwards) out of its position of rest until it is in or under the ski boot heel, this boot being able to tilt on a curved line, about the front holding element, when the lever 6 is preferably pivoted backwards;

the fitting pedal 7 is tensioned by a spring and, in its position of rest, automatically assumes a position holding it, by outward tilting, outside of the curved line of the ski boot heel, the boot then being able to tilt about the front boot support;

the fitting pedal 7 is composed of a sprung metal wire or made of elastic material and the form of the wire itself can intrinsically give it a spring effect;

the fitting pedal 7 is spring-loaded;

the fitting pedal 7 is configured in such a way that it acts, jointly with the contact means 9 of the lever 6 directly or indirectly touching the fitting pedal 7 that can tilt on a curved line about the point of rotation 5 and thus being able to tilt it inwards into the tilting zone of the ski boot 3;

the fitting pedal 7 is equipped with one or more abutments 8 interacting with the contact means 9 in the lever 6;

the contact means 9 in the lever 6 are equipped with an anti-overload protection;

the lever 6 comprises one or more cleats 19 that can be formed by one or more parts 12, 19 arranged in such a way that they can tilt inwards as required under the ski boot heel, the heel of the boot being able to tilt on a curved line about the front boot support, in climbing position;

in the "closed position" of the heel support 11', a ski brake stop 15 is tripped thereby, that is to say by the heel grip 11;

lateral guiding abutments 13 replace, in the zone of bearing on the heel, the lateral guides missing from the heel grip 11 for the ski boot 3.

So, it emerges from the invention that this fixing has the following characteristic positions:

The fitting position, ready for fitting, in which the heel grip 11 is in raised position, pivoted upwards and backwards or even in open position and in which the fitting pedal 7, mobile relative to the heel grip 11, is pivoted downwards for the boot to be able to be pressed on top during fitting to drive the forward rotation of the heel grip 11 and tilt it to its position of closure and therefore of holding of the heel of the boot.

The descent position, in which the heel grip 11 is pivoted forwards and downwards to hold the heel of the boot, the heel grip then being in closed position, the fitting pedal 7 being positioned under the heel of the boot.

The climbing position, in which the heel grip 11 is slightly raised upwards and backwards in an open or possibly open intermediate position, while the fitting pedal 7 is pivoted upwards and therefore is retracted to come to be housed in the top part against the top part of the heel grip 11.

The boot is therefore no longer held by its heel and it can be pivoted upwards about the front boot holding element to allow the user to walk for the climbing phases. The retraction of the fitting pedal 7 allows the heel 3' of the boot to not be hampered by this element 7 and the heel can descend until it bears on the base of the rear holding element.

The fitting pedal is therefore mobile relative to the heel grip. This mobility can be obtained according to several embodiments. It can be mounted to be rotationally mobile relative to the rear holding element. As a variant, it can be provided with another movement, provided that this movement comprises a backwards component in climbing position. Furthermore, the fitting pedal can be mounted on the heel grip or on a fixed part linked to the base of the rear holding element.

Figure 9:
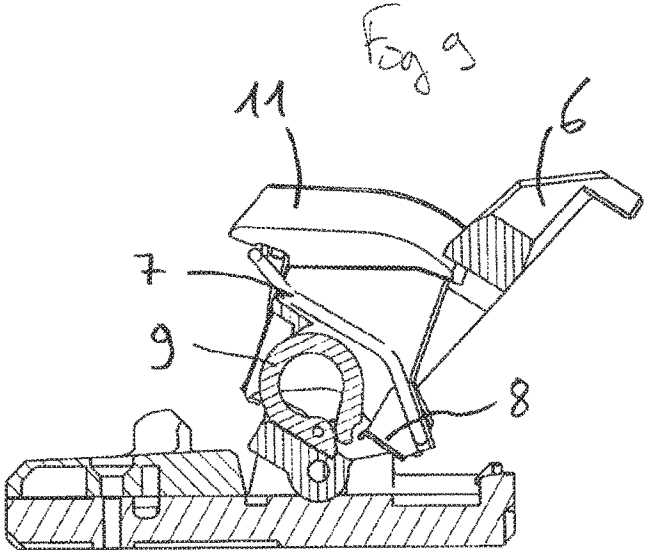
FIG. 9 illustrates a cross-sectional side view of a rear boot holding element according to the embodiment of the invention in a climbing position.
Figure 8:
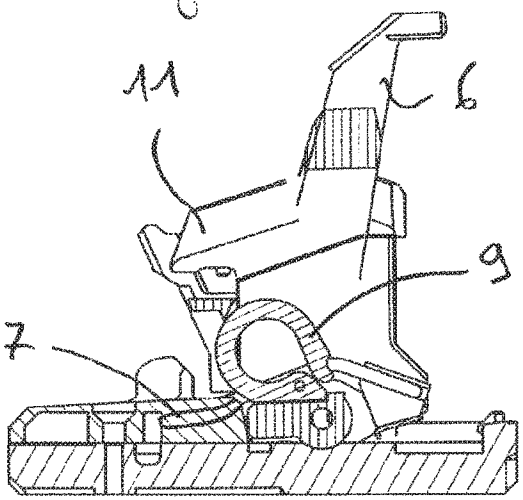
FIG. 8 illustrates a cross-sectional side view of a rear boot holding element according to the embodiment of the invention in a descent position.
Figure 10:
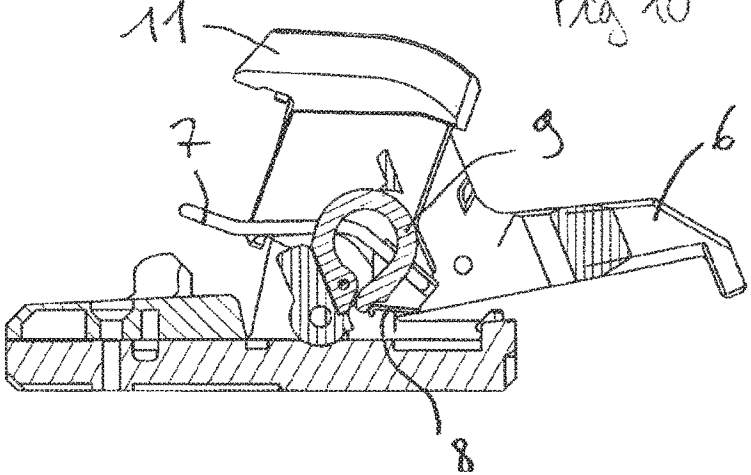
FIG. 10 illustrates a cross-sectional side view of a rear boot holding element according to the embodiment of the invention in a fitting position.

FIGS. 8 to 10 more specifically illustrate the different positions of the fitting pedal 7 in the different positions of the rear holding element for a boot. In FIG. 8, the rear holding element is in descent position. The heel grip 11 is in closed position, intended to hold the heel of a ski boot (not represented). The fitting pedal 7 is in lowered position, arranged under a ski boot. FIG. 9 represents the opposite, climbing, position. The heel grip is raised, has released a ski boot (not represented). The fitting pedal 7 is in raised position, comes into abutment under the jaws of the heel grip 11. In this so-called position of rest, it is retracted. It is in pushed-back position. The heel of a ski boot can come to bear on the base of the rear retaining element or, as a variant, on a cleat, but never risk striking the fitting pedal. The fitting pedal 7 has a form with spring effect, which allows it to rise automatically into this position of rest when the heel grip is raised. As a variant, an independent spring can act on the fitting pedal. In this position, the lever 6 is positioned at the back and releases the fitting pedal 7. The abutment 8 no longer interacts with the contact means 9. FIG. 10 represents an intermediate, fitting, position, in which the fitting pedal is lowered, into a position capable of receiving the pressure of a ski boot and driving the heel grip to its closed position, in a traditional manner. This intermediate position or fitting position is reached by the lever 6 which acts on the contact means 9 by driving them in rotation, these contact means 9 then coming to bear on the rear lugs of the fitting pedal 7, which allows the fitting pedal 7 to be tilted downwards, into the fitting position.

Furthermore, this fixing has a brake locking system 15, 28, given that it is necessary to have an active brake, which can tilt from the raised, closed, inactive position to the open, active position lowered into the snow, during descent phases, whereas it is necessary to block the brake in raised, closed, inactive position during climbing phases.

As explained above, the ski fixing is equipped with a braking device. The latter can occupy two configurations. A first blocked configuration, in which it remains in raised, inactive position, independently of the rear holding element and of the position of the boot. This blocked configuration is necessary in climbing position. The second configuration is, on the contrary, unblocked, which allows the braking device to occupy two positions: a braking position, lowered into the snow, and a non-braking position, raised. This second configuration is necessary in a descent phase.

Figure 12:
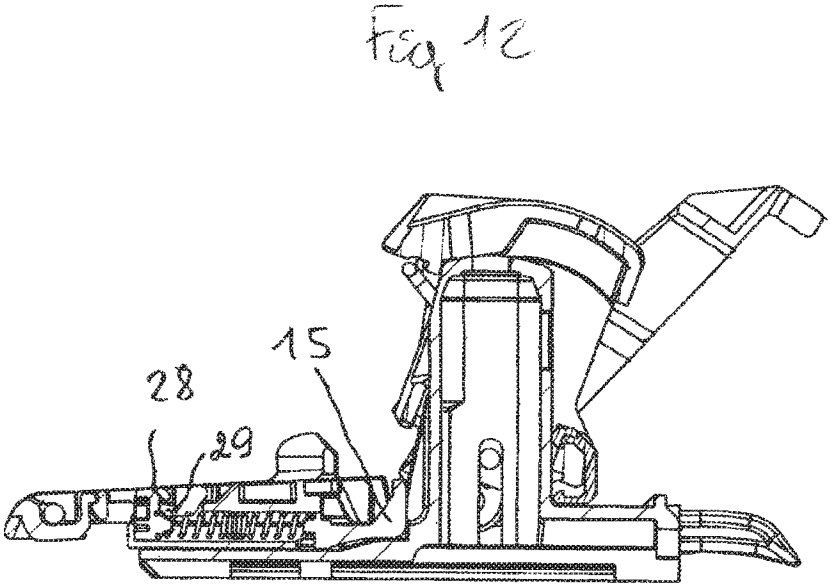
FIG. 12 illustrates a cross-sectional side view of the braking device of the rear boot holding element according to the embodiment of the invention in a climbing position.
Figure 11:
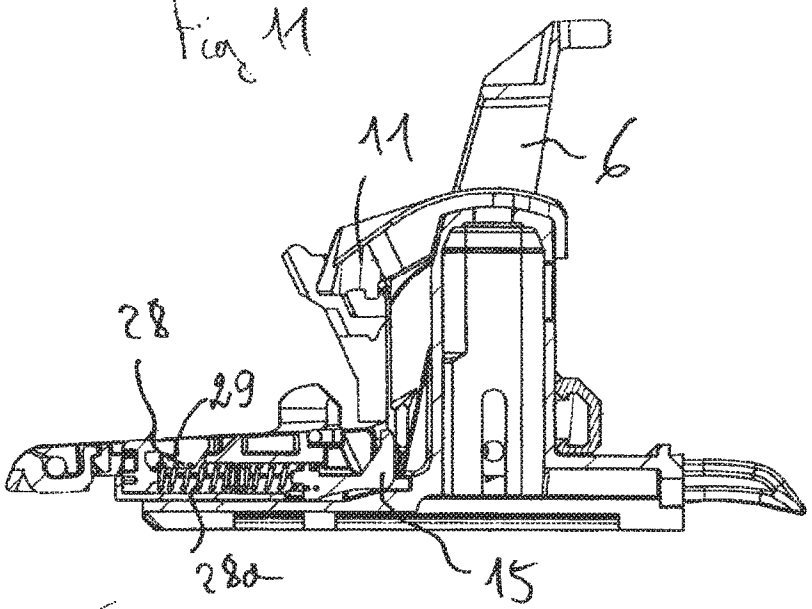
FIG. 11 illustrates a cross-sectional side view of a braking device of the rear boot holding element according to the embodiment of the invention in a descent position.
Figure 12:
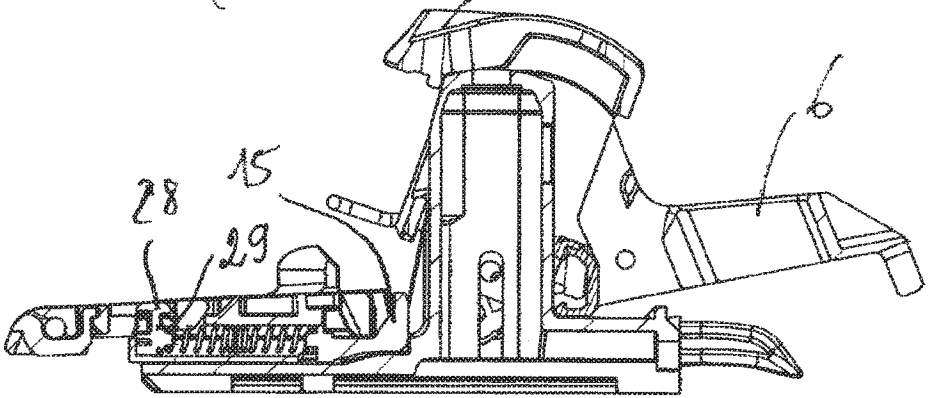

FIGS. 11 to 13 more specifically illustrate the different positions of the braking device in the different positions of the rear holding element for a boot. In FIG. 11, the rear holding element is in descent position. The braking device is in unlocked position. In this position, the heel grip 11 exerts a forward thrust on the brake control 15, which induces the forward displacement of the brake lock 28. The brake control 15 has been translated forwards and is therefore in front position and the brake lock 28 is also in front position, in which it cannot lock the brake branches 24 since this brake lock 28 does not catch the brake pedal 29. FIG. 12 represents the opposite, climbing position. The heel grip is raised, has released a ski boot (not represented). In this position, the heel grip 11 no longer exerts forward thrust on the brake control 15 and the return spring 28*a* drives the brake control 15 and the brake lock 28 in translation backwards, which allows the lock 28 to catch the hook 29 produced on the brake pedal to thus lock the brake in non-braking position. The lock of the brake can cooperate with the brake pedal, or, as a variant, any part of the brake, to hold it in non-braking position and prevent any movement of the brake.

FIG. 13 represents an intermediate, fitting position, in which the braking device is in the same position as previously.

This brake locking solution offers the advantage of obtaining a locking and unlocking of the brake that is automatic, without manual intervention from the user.

The invention claimed is:

1. A rear holding element for a ski boot comprising:

a heel grip, a lever, and a fitting pedal, wherein the fitting pedal is mobilely supported by the heel grip, and wherein the fitting pedal is movable between the following positions:

a tilted rest position against the heel grip in which the fitting pedal is outside of a trajectory of the ski boot in a climbing position of the rear holding element, wherein in the climbing position of the rear holding element the ski boot is fixed to a ski at a front end of the ski boot and is not fixed to the ski at a rear end of the ski boot such that the rear end of the ski boot freely follows along the trajectory, and a fitting position in which the fitting pedal is on the trajectory of the ski boot.

2. The rear holding element for the ski boot according to claim 1, wherein the fitting pedal is articulatedly mounted on the heel grip.

3. The rear holding element for the ski boot boot according to claim 1, wherein the fitting pedal is also movable to the following third position:

a descent position in which the ski boot is fixed relative to the ski at the rear end of the ski boot and the front end of the ski boot.

4. The rear holding element for the ski boot according to claim 1, wherein the fitting pedal is spring-tensioned and, in the tilted rest position, automatically assumes a position holding the fitting pedal outside of the curved line of a ski boot heel, by outward tilting.

5. The rear holding element for the ski boot according to claim 1, wherein the fitting pedal is composed of a sprung metal wire or elastic material.

6. The rear holding element for the ski boot according to claim 1, wherein the fitting pedal is spring-loaded.

7. The rear holding element for the ski boot according to claim 1, wherein the lever forms a climbing aid taking the form of a ski boot cleat and allows for the locking of a heel of the ski boot.

8. The rear holding element for the ski boot according to claim 7, wherein the lever can occupy (i) a forward-tilted position in which the lever forms a boot cleat in the climbing position of the rear holding element and (ii) a backward-tilted position in which the lever opens the heel grip to release the ski boot.

9. The rear holding element for the ski boot according to claim 7, wherein the fitting pedal is positioned to directly or indirectly interact with a contact of the lever along a curved line about a point of rotation of the lever, thus making the fitting pedal tilt or not into the trajectory of the ski boot.

10. The rear holding element for the ski boot according to claim 9, wherein the fitting pedal is equipped with one or more abutments interacting with the contact of the lever.

11. The rear holding element for the ski boot according to claim 10, wherein the lever comprises one or more cleats formed by one or more parts, said one or more cleats being tiltable inwards under the trajectory of the ski boot, the trajectory being a trajectory of a heel of the ski boot that is not fixed to a ski at the rear end of the ski boot, and that follows a curved line about a front holding element for the ski boot that is fixed to the ski.

12. The rear holding element for the ski boot according to claim 1, further comprising a brake, a brake lock, and a brake control of the brake lock, wherein the brake control is capable of cooperating with the heel grip or the lever to lock the brake in a non-braking position in the climbing position of the rear holding element, and to unlock the brake in a descent position of the fitting pedal.

13. The rear holding element for the ski boot according to claim 12, wherein the brake lock cooperates with a part of the brake pedal in a locked position of the brake.

14. A ski fixing, comprising:

a front holding element for the ski boot, and the rear holding element for the ski boot according to claim 1.

15. A touring ski, comprising the ski fixing according to claim 14.

16. The rear holding element for the ski boot according to claim 2, wherein the fitting pedal is spring-tensioned and, in the tilted rest position, automatically assumes a position holding the fitting pedal outside of the curved line of a ski boot heel, by outward tilting.

17. The rear holding element for the ski boot according to claim 2, wherein the fitting pedal is composed of a sprung metal wire or elastic material.

18. The rear holding element for the ski boot according to claim 2, wherein the fitting pedal is spring-loaded.

19. The rear holding element for the ski boot boot according to claim 2, wherein the lever forms a climbing aid taking the form of a ski boot cleat and allows for locking of a heel of the ski boot.

* * * * *